US006412834B1

(12) United States Patent
Waitai et al.

(10) Patent No.: US 6,412,834 B1
(45) Date of Patent: Jul. 2, 2002

(54) WINDOW FASTENER

(75) Inventors: Rana James Waitai, Auckland (NZ); Steven Frank Wilkes, Walsall (GB)

(73) Assignee: Interlock Group Limited (NZ)

( * ) Notice: Subject to any disclaimer, the term of this patent is extended or adjusted under 35 U.S.C. 154(b) by 0 days.

(21) Appl. No.: 09/691,625

(22) Filed: Oct. 17, 2000

(30) Foreign Application Priority Data

Oct. 18, 1999 (NZ) ..... 500423

(51) Int. Cl.[7] ..... E05C 3/04

(52) U.S. Cl. ..... 292/197; 292/240; 292/241; 292/52; 292/78; 292/194; 292/200

(58) Field of Search ..... 292/240, 241, 292/52, 78, 194, 200

(56) References Cited

U.S. PATENT DOCUMENTS 4,801,164 A * 1/1989 Mosch ..... 292/204
4,826,222 A * 5/1989 Davis ..... 292/241
RE35,463 E * 2/1997 Vetter et al. ..... 292/48
5,839,767 A * 11/1998 Piltingsrud ..... 292/336.3

FOREIGN PATENT DOCUMENTS

DE 3805196 * 8/1989 ..... E05B/13/10
GB 2258008 * 1/1993 ..... E05C/3/04

* cited by examiner

*Primary Examiner*—Anthony Knight
*Assistant Examiner*—Matthew E. Rodgers
(74) *Attorney, Agent, or Firm*—Blakely Sokoloff Taylor & Zafman

(57) ABSTRACT

A window fastener having a mounting base (21), a latching flap (12) moveably coupled thereto, a handle (14) and a latching tongue (15). the handle (14) is movable between first and second positions and is coupled to the latching tongue (15) so that the latching tongue moves the latching flap (18) when the handle (14) moves to a latching position. A movement inducing mechanism (34, 41) operable by the handle (14) causes movement of the flap (12) to occur when the handle is moved from the latching position to a non-latching position.

14 Claims, 8 Drawing Sheets

WINDOW FASTENER

BACKGROUND OF THE INVENTION

This invention relates to a window fastener.

To latch a projected hung window in a closed position, it is common to have one or more handle operated fasteners mounted with the sash. Each fastener engages with the window frame when the sash is in the closed position to latch the sash closed. It is widely known to construct the fastener so that a tongue formed integrally with the handle wedgingly engages with a wedge plate mounted with the window frame.

In our European patent specification 0133051, there is disclosed a window fastener where a separate wedge plate is not required. In EP 0133051 there is disclosed a handle which, during movement between first and second positions, causes a flap to move between latching and release positions. Thus when the window sash is moved to a closed position the handle can be operated to cause the flap to overlap the window frame and thereby retain the sash in a closed position. However, moving the handle to the other position causes the flap to move to a release position and permits the window sash to be opened. A window fastener of this type has been very successful commercially.

A draw back with the window fastener of EP 0133051 is that the fastener is "handed" because the tongue engages an upstand on the flap to cause the flap to move from a latching position to a non-latching position. Accordingly a manufacturer must provide right and left hand fasteners. This leads to the requirement that the manufacturer must have stock holdings of left and right handed fasteners and can result in the need for different manufacturing runs for the different components for the left and right hand fasteners.

SUMMARY OF THE INVENTION

It is therefore an object of the present invention to provide a window fastener which has a latching flap operable by a handle, the fastener being of a construction where it is not required that a handle tongue be used to create movement of the flap from its latching position.

Broadly according to one aspect of the invention there is provided a window fastener having a mounting base, a latching flap moveably coupled thereto, a handle and a latching tongue, the handle being movable between first and second positions and coupled to the latching tongue whereby the latching tongue moves the latching flap when the handle moves from the first position to the second position, characterised in that the fastener includes a movement inducing means operable by said handle, the movement inducing means being engageable with the flap to cause movement of the flap when the handle is moved from the second position to the first position.

DESCRIPTION OF THE PREFERRED EMBODIMENT

Figure 1:
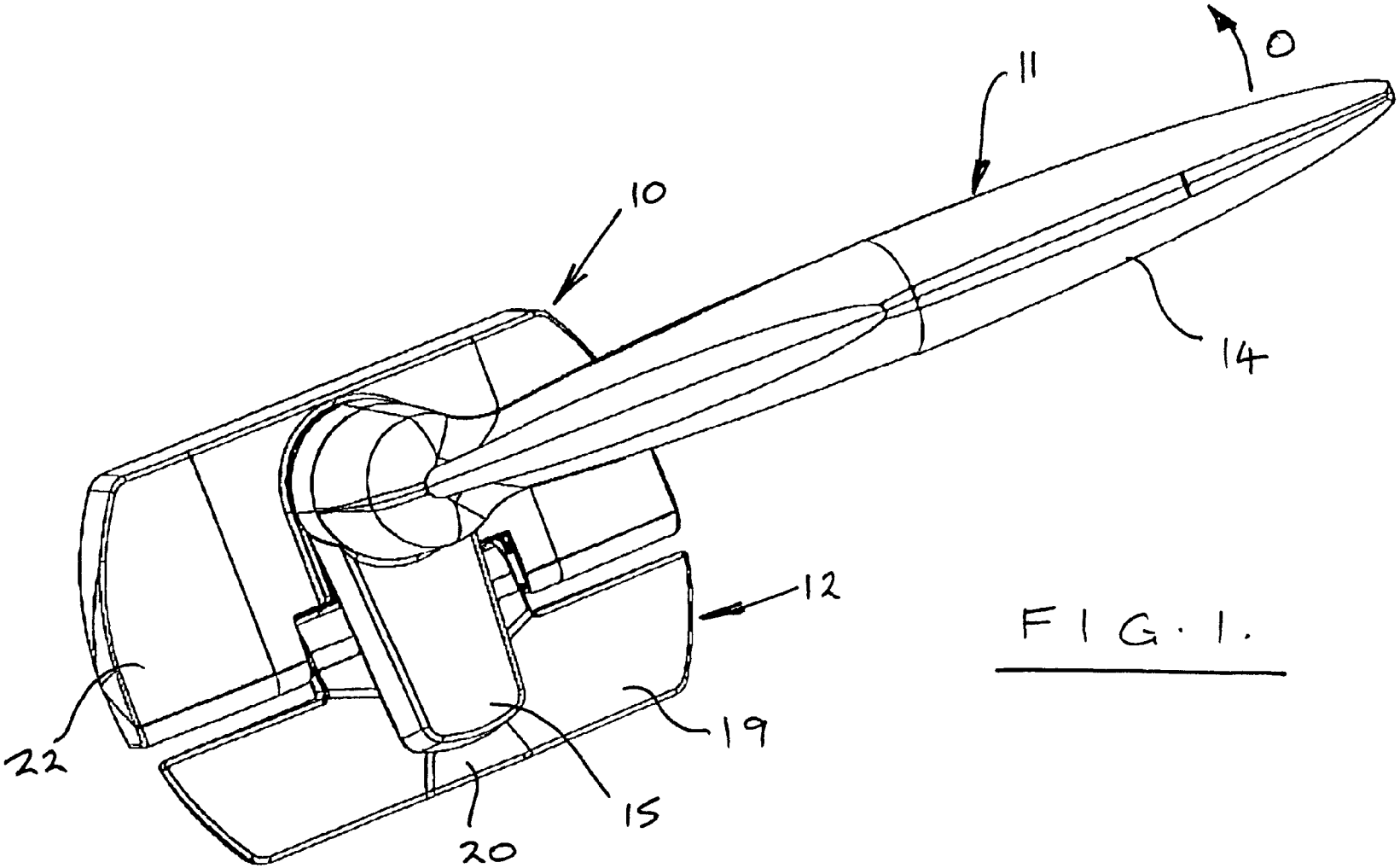
FIG. 1 is a perspective view of the window fastener according to the invention.

The window fastener according to the present invention in one preferred embodiment includes a mounting 10 with which a handle 11 is pivotally mounted. A flap 12 is pivotally mounted to the mounting 10 and pivots about an axis which is substantially at right angles to the axis about which the handle 11 pivots.

The handle 11 includes a boss section 13 from which a lever 14 extends. The lever 14 is formed so as to be grasped by the hand of a user. At substantially right angles to the direction to which the lever 14 extends, there is a latching tongue 15.

The flap 12 (see FIG. 7) has a mounting portion 16 which incorporates a pair of stub axles 17. The central axis of the stub axles 17 coincides with the axis of rotation 18 of the flap 12.

The flap 12 is profiled so as to provide a pair of oppositely sloping faces 19. When the flap 12 is in the release position (see FIG. 2), an edge of the tongue 15 lies adjacent one of the slopping surfaces 19. As the lever 14 is rotated in the direction of arrow C (see FIG. 2), the tongue 15 slides across the surface 19 causing the flap 12 to pivot about the pivot axis 18 until it reaches the latching position as shown in FIG. 1. In the latching position the tongue 15 is located on or above the surface 20 which essentially separates the two slopping surfaces 19.

Figure 5:
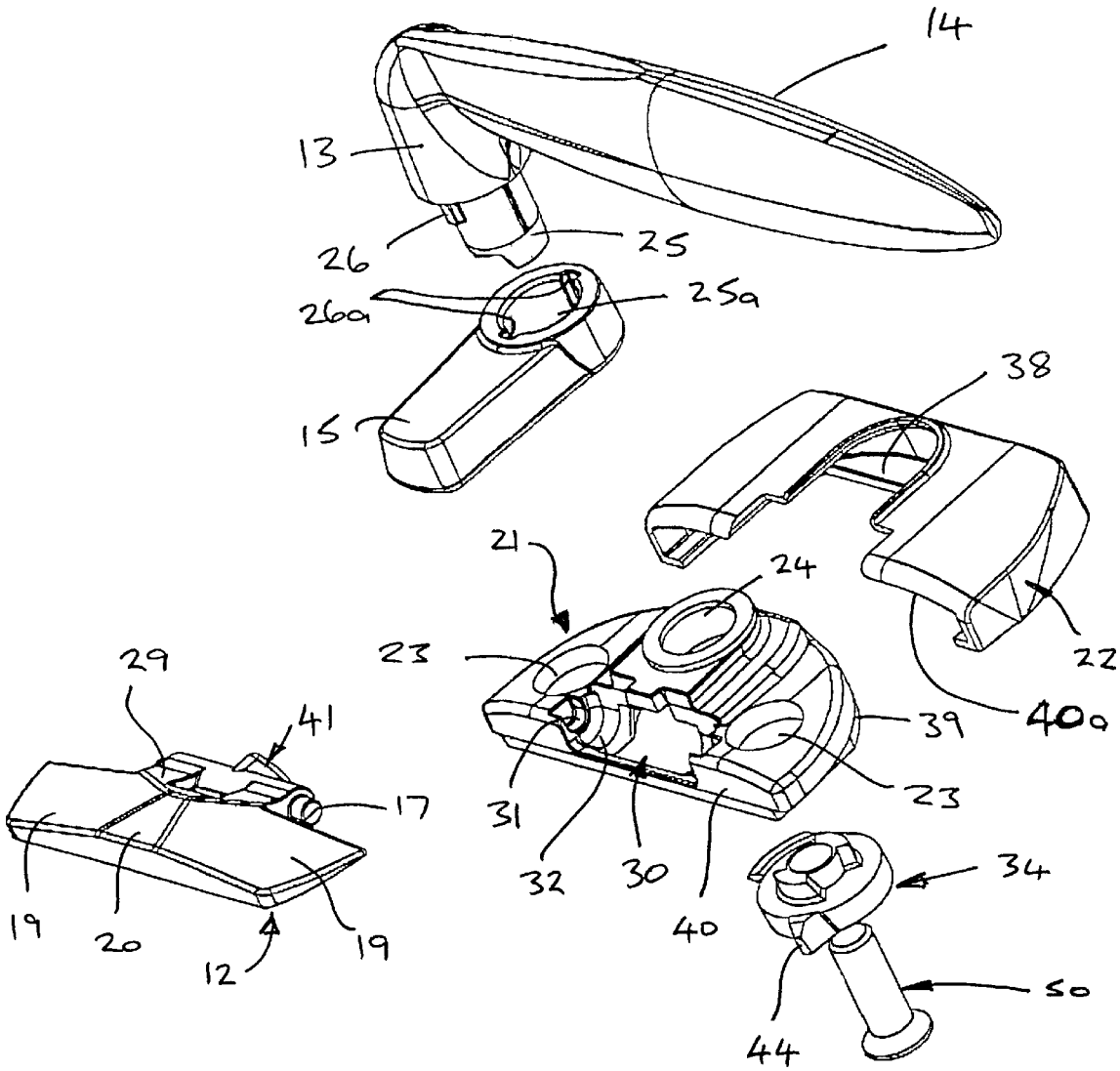
FIG. 5 is an exploded view.
Figure 6:
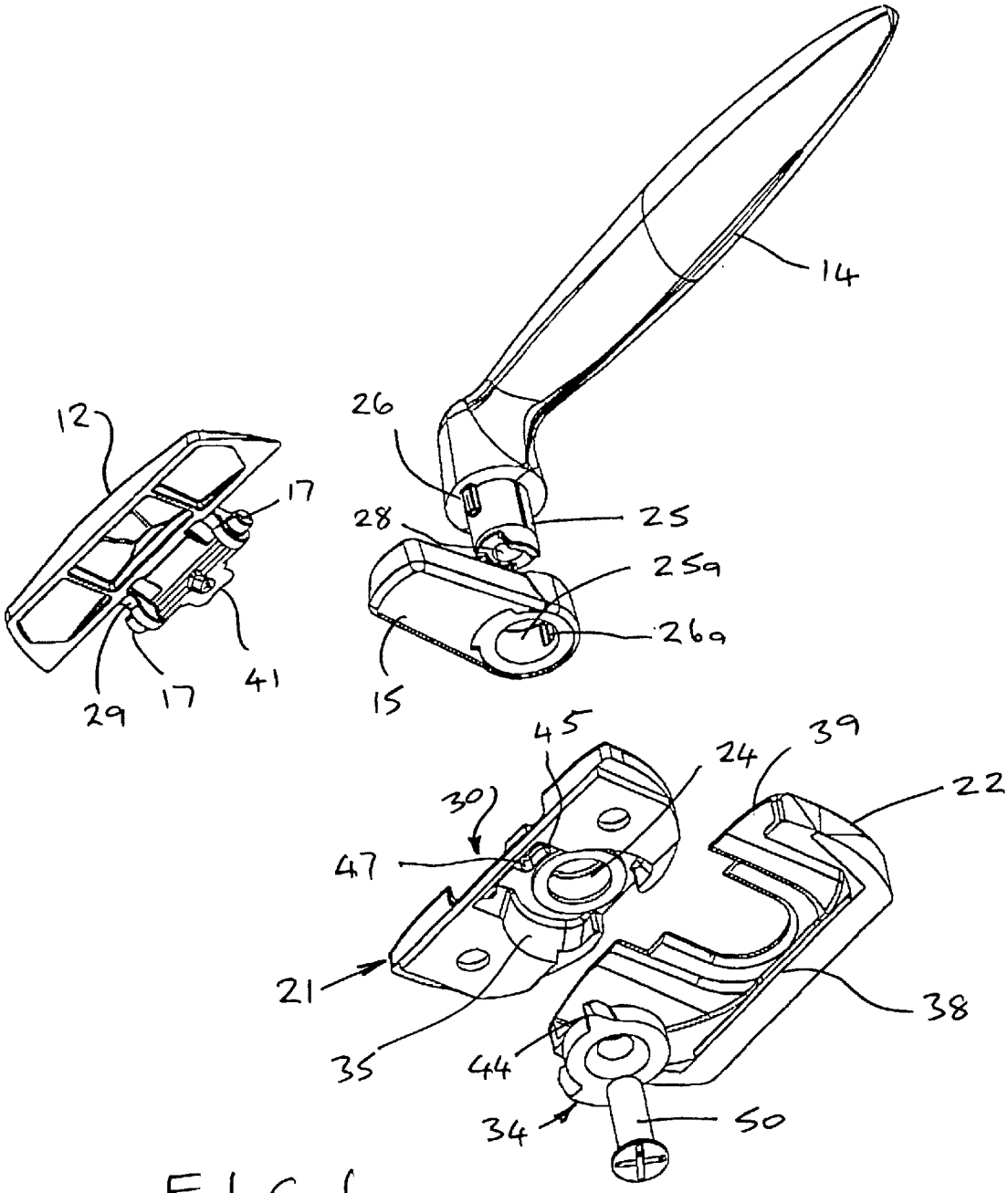
FIG. 6 is a further exploded view.

In a preferred form of the invention the mounting 10 is formed by a base 21 and a cover 22 (see FIGS. 5 and 6). The base 21 has a pair of openings 23 through which mechanical fasteners can engage to mount the base 21 to the window sash. The base 21 further has a bore 24 into which a spigot or shaft 25 forming part of and extending from tongue 15 can rotatably locate.

As can be seen in FIGS. 5 and 6, the lever 14 and boss 13 are integrally formed and preferably the tongue 15 is a separate component. The tongue 15 has a bore 25*a* in which engages spigot 25 of boss 13. For angular location projections 26 of spigot 25 fit into recesses 26*a* in bore 25*a* to key the tongue with the handle. As will hereinafter be explained, a screw or like mechanical fastener 50 extends through a cam washer 34 (see FIG. 5) bore 25*a* and into a bore 28 in the spigot 25 of boss 13.

The stub axles 17 of flap 12 are mounted by a shaped projection 29 extending from the main body of the flap 12. A recess 30 is formed in base 21 within which projection 29 can engage so that the stub axles 17 can locate in a pair of opposed recesses 31 in the opposing walls at the sides of recess 30.

In the preferred form a curved shoulder 32 is formed adjacent recess 31. The curved surface 33 adjacent stub axles 17 rotatably engages with the shoulders 32. As a result the flap 12 is mounted to the base 21 by not only the stub axles 17 but also the sliding engagement of surface 33 with shoulder 32.

The projection 29 and stub axles 17 are retained in the recess 30 by cover 22 as will hereinafter be explained.

There is also provided a cam washer 34. This cam washer fits in a shaped recess 35 in the underside of mounting base 21. The cam washer 34 has a turret 35 which engages in bore 24. The spigot 25 of tongue 15 engages in the 20 bore of turret 35.

Figure 8:
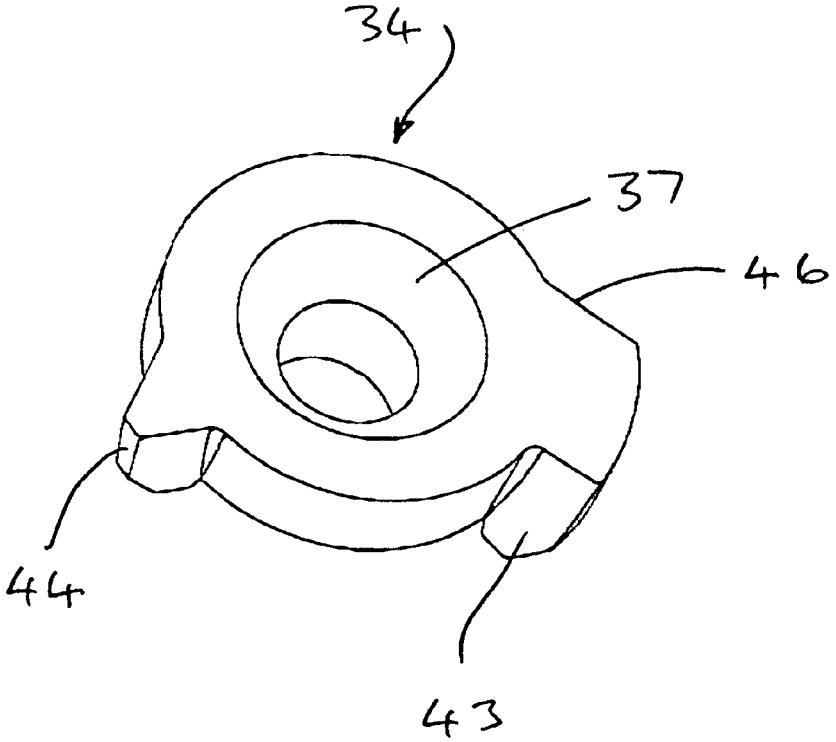
FIG. 8 is a perspective view of the cam washer.
Figure 9:
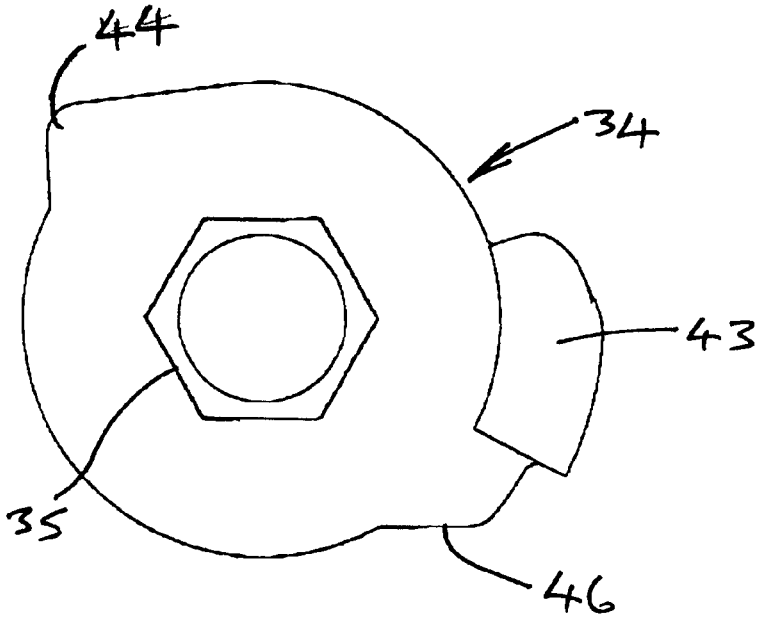
FIG. 9 is a plan view of the cam when viewed from the side opposite to that uppermost in the view shown in FIG. 8.

A headed fastener 50 can be inserted shank first through cam washer 34 to pass through spigot 25 and projection 26 as previously mentioned and engage in the bore 28 of boss 13 to thereby mount the cam washer 34, tongue 15 and handle 11 to the mounting base 21. The head of the headed fastener 50 locates in mouth 37 on the under side of cam washer 34 (see FIG. 8).

Once the handle 11, tongue 15, flap 12 and cam washer 34 are mounted with base 21, the cover 22 is located on the base 21 in a snap-lock fitting. Cover 22 ensures that the flap 12 remains in its mounted position on base 21. In a preferred form of the invention the snap fit of the cover 22 is achieved by a ledge 38 engaging under a rebate 39 of the base 21 while lips 39 clip down over the wall 40 of the base 21.

The cover 22 not only retains the flap 12 in place but also adds strength to the base 21. A further advantage is that it covers what can often be unsightly mounting screws in openings 23. Thus with the cover in place the mounting base takes on a much cleaner aesthetically pleasing appearance than is the case was known window fasteners.

In a preferred arrangement, the flap 12 is an interference fit with the base 21 so as to ensure that the flap 12 is retained by the base independent of a cover. It also facilitates assembly of the flap 12 to the base 21 during assembly of the fastener.

Figure 7:
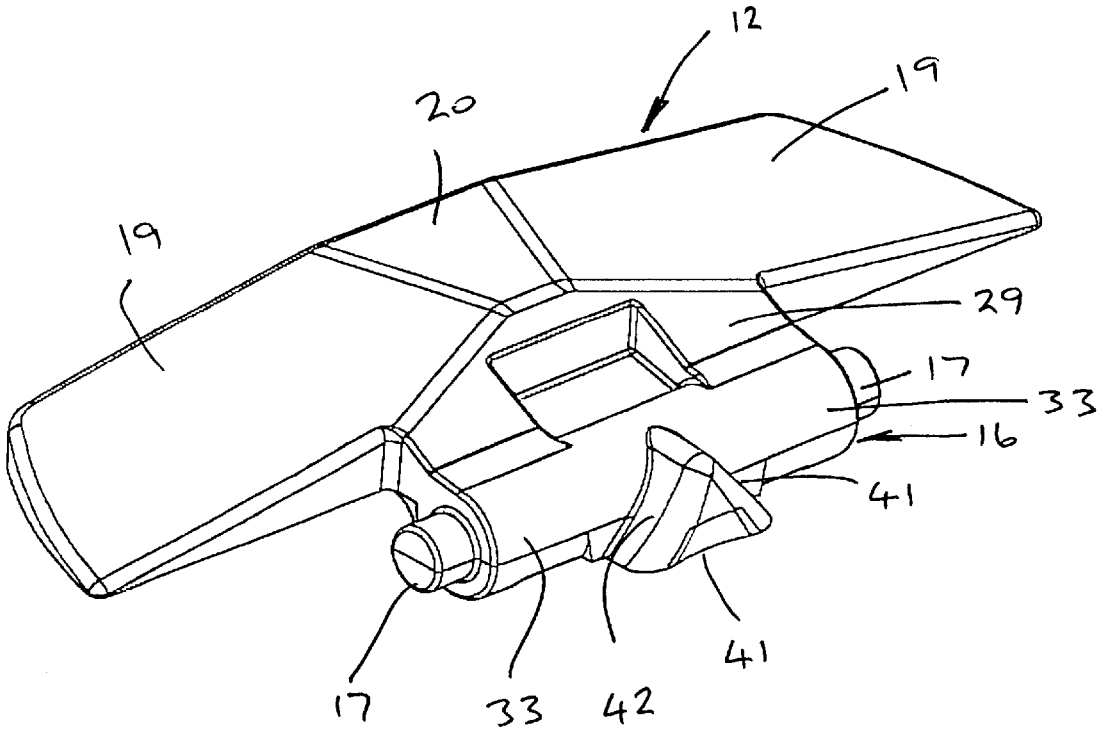
FIG. 7 is a perspective view of the flap.

The projection 29 of flap 12 carries a generally triangular follower 41 (see FIG. 7). This provides a pair of surfaces 42.

Figure 2:
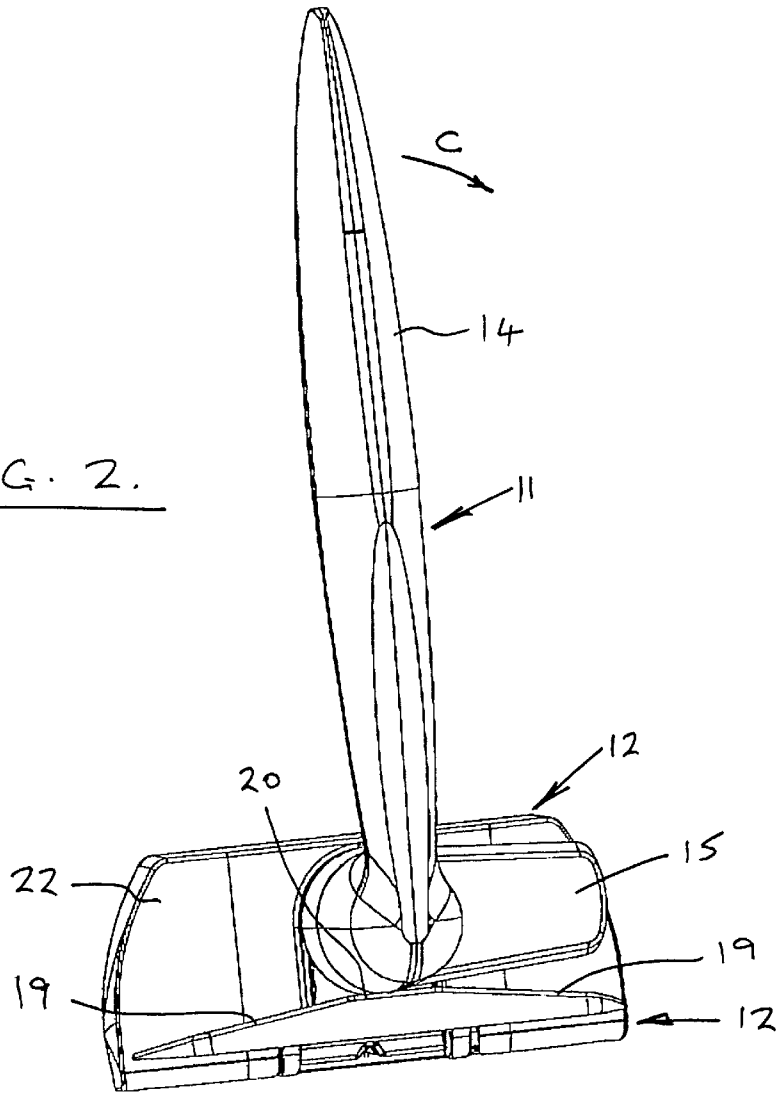
FIG. 2 is a similar view but with the fastener in a non latching position.
Figure 3:
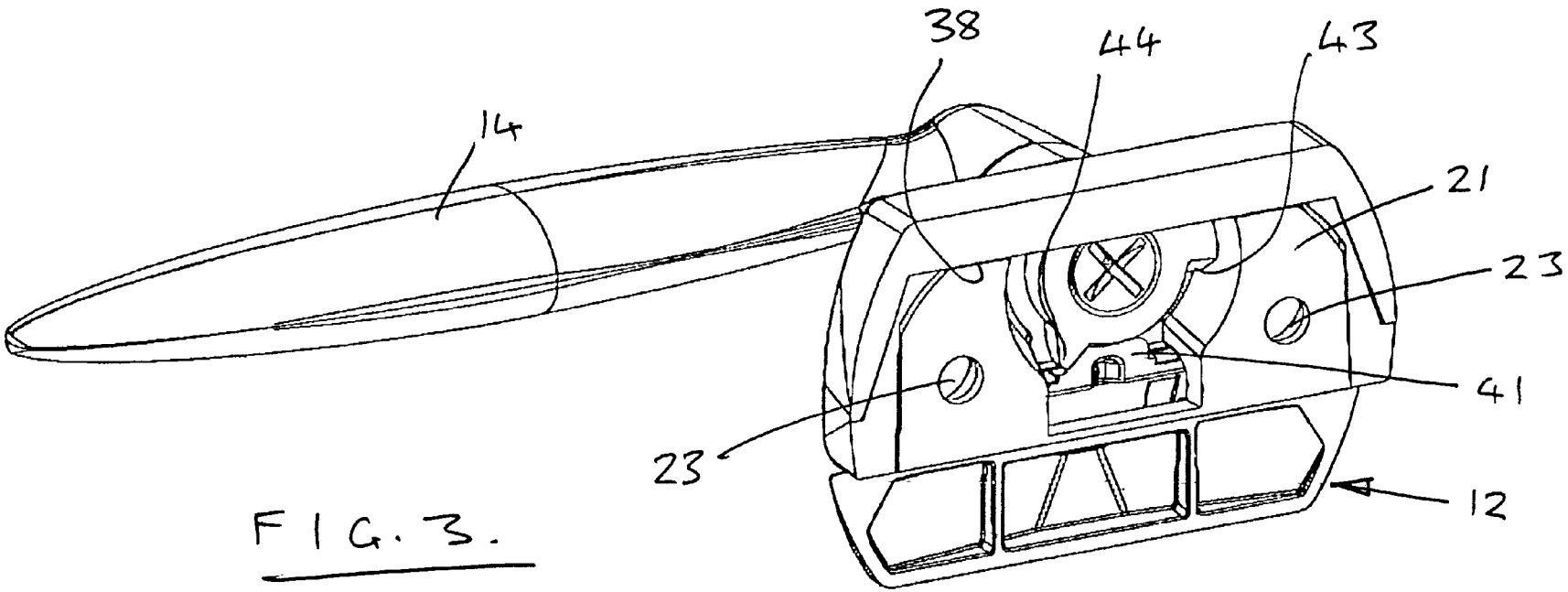
FIG. 3 is an underside perspective view of the arrangement shown in FIG. 1.

Projecting from the side of the cam washer 34 is a cam surface 43. As the lever 14 is moved in the direction of arrow O the cam surface 43 inter-engages with a surface 42 so that the flap 12 is driven to the unlatched position as shown in FIG. 2. However, it will be seen from FIG. 3 that the lever 14 needs to move a distance before the cam surface 43 comes into engagement with a surface 42. This enables the tongue 15 to move clear of the flap 12 before the inter-engaging cam 43 and surface 42 move the flap 12 to its unlatched position.

Figure 4:
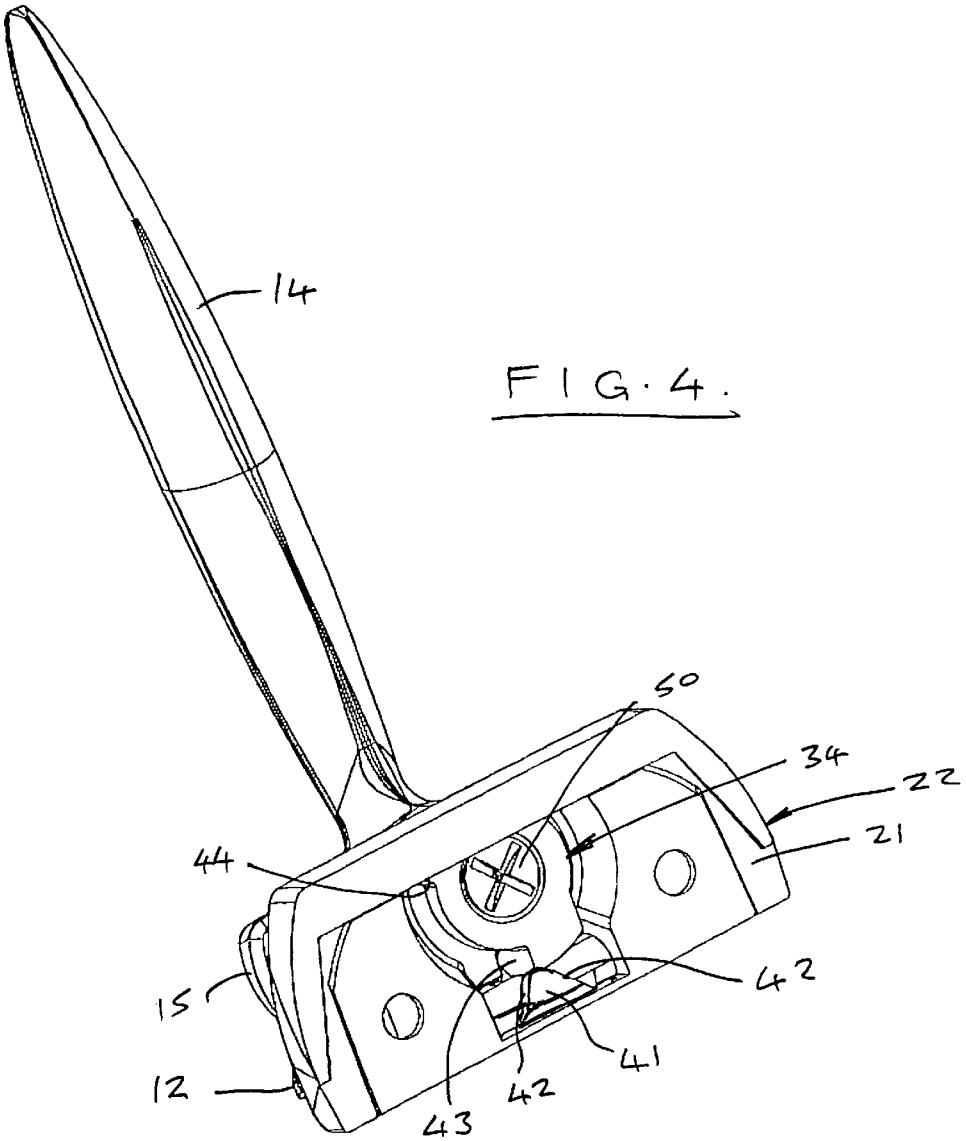
FIG. 4 is a perspective underside view of the arrangement shown in FIG. 2.

Disposed at the opposite side of the cam washer 34 is a nose 44. This contacts a surface 45 of the base 21 when the handle 11 has moved to the "open" position (see FIGS. 2 and 4). The inter-engagement of nose 44 and surface 45 provides an end stop which determines the fully opened position of the handle 11.

Adjacent cam surface 43 is a shoulder 46. This shoulder 46 comes in contact with a surface 47 of the base 21 so that when the handle is in the fully closed position (FIGS. 1 and 3), an end stop is established by the contact of shoulder 46 and surface 47. Therefore not only does the cam washer 34 provide the means of moving the flap 12 to its unlatched position, it also provides end stops which determine in conjunction with appropriately positioned stop surfaces of the base 21, the fully opened and fully closed position of the handle 10.

It will be appreciated that the handle 10 can be located at one of two positions 180° apart on the projection 26 of the tongue 15. Thus the "hand" of the fastener can be simply selected by releasing the headed fastener holding the cam washer 34 and tongue 15 to the base 21 and moving the handle 10 so that the lever 14 projects from the required side of the tongue 15.

In a preferred form of the invention the cam washer 34 is configured as are the end stop surfaces of the base 21 so that the cam washer correctly operates irrespective of whether the lever 14 is located "left" handed or "right" handed. However, the cam washer 34 as illustrated is not "non handed". Thus when changing the hand of the handle 10 it is necessary with the illustrated form of the invention to replace the cam washer 34 with that which is correct for the required "handing" of the handle 10. This is readily achieved as the headed fastener coupling the components together needs to be removed to enable the handle to be repositioned and during this operation the cam washer 34 can simply be replaced.

In the ideal configuration of the window fastener, all the components are non handed thereby meaning that the installer only needs to correctly position the handle 10 for the handing required. However, in the illustrated arrangement, the manufacturer will need to manufacture two different configurations of cam washer 34 and the installer will simply select the correct cam washer for the required handing of the fastener.

The present invention thus provides a fastener whereby different "hands" of handle are not required. Also by having an internal mechanism for moving the flap to the non latching position, it is not necessary for the tongue 15 to play any part in the moving of the flap to the non latched position. Consequently a projection on the flap 12 which inter-engages with the tongue 15 so as to drive the flap to the non latching position is not required. This not only results in the flap 12 not being handed but improves the aesthetic appeal of the fastener.

The aesthetic appeal of the fastener is also greatly enhanced by the cover which engages with the mounting base 21. As mentioned previously, the cover also adds to the rigidity and strength of the base 21. The need to be able to deform partially the mounting portion of the flap to fit with the mounting base as required in the fastener of EP 0133051 is therefore not required. This further leads to increased strength and retention of the flap with the mounting base 21. Also the choice of material from which the flap can be made is increased as the need to be able to deform at least part of the flap for fitting is no longer a requirement.

The components of the fastener can be diecast or moulded from a suitable plastics material or a combination of plastics materials and/or diecasting. It is envisaged that in a preferred form of the invention the fastener will be manufactured by principally diecasting.

What is claimed:

1. A window fastener comprising a mounting base, a latching flap pivotally coupled to the mounting base, said flap being movable between a latching position and a non-latching position, a handle movable between first and second positions, a latching tongue coupled to the handle, the latching tongue being engageable with the latching flap when the flap is in the latching position and the handle has moved from the first position to the second position, the handle also being operably coupled to a movement inducing mechanism, the movement inducing mechanism operatively being coupled with the latching flap so that as the handle is moved from the second position to the first position the flap is moved by the movement inducing mechanism to the non-latching position.

2. A window fastener as claimed in claim 1 wherein the movement inducing mechanism is located internally of the mounting base.

3. A window fastener as claimed in claim 1 wherein the movement inducing mechanism includes a first member rotationally coupled to the handle and a second member coupled to a pivot mounting portion of the latching tongue.

4. A window fastener as claimed in claim 1 wherein the movement inducing mechanism includes a cam washer coupled to the handle to be rotatable in response to movement of the handle, the cam washer having an engagement surface, the latching tongue being coupled to the mounting base by a pivot mount such that the latching tongue can move between the first and second positions about a pivot axis, the movement inducing mechanism further including a follower coupled to the pivot mount and engageable by said engagement surface.

5. A window fastener as claimed in claim 4 wherein the pivot mount is located in an opening in the mounting base which communicates with a cavity in the mounting base in which the cam washer is located.

6. A window fastener as claimed in claim 4 wherein the cam washer is fastened to a shaft portion of the handle, said shaft portion being rotatably located in a journal in the mounting base.

7. A window fastener as claimed in claim 4 wherein the pivot mount is captured onto the mounting base by a cover removably attached to the mounting base.

8. A window fastener as claimed in claim 7 wherein the cover when in place on the mounting base conceals openings through which fasteners can be engaged for, in use, fastening the mounting base to a structure.

9. A window fastener as claimed in claim 4 wherein the mounting base includes stop surfaces and the cam washer includes an abutment whereby engagement of the abutment with respective of said stop surfaces determines said first position and said second position.

10. A window fastener as claimed in claim 1 wherein the mounting base has attached thereto a removable cover.

11. A window fastener as claimed in claim 1 wherein the handle is coupled to the latching tongue so that the angular disposition of the handle relative to the tongue is adjustable.

12. A window fastener as claimed in claim 11 wherein the handle is keyed to the latching tongue such that the handle can be adjusted into one of two different angular dispositions relative to the latching tongue.

13. A window fastener as claimed in claim 12 wherein the latching flap includes two inclined surfaces, the latching tongue being engageable with a respective one of the inclined surfaces dependent on the particular angular disposition of the handle relative to the latching tongue.

14. A window fastener as claimed in claim 1 further indicating stop means which define said first position and said second position.

* * * * *